US006928966B1

(12) United States Patent
Sun

(10) Patent No.: US 6,928,966 B1
(45) Date of Patent: Aug. 16, 2005

(54) SELF-REGULATING ELECTROHYDRAULIC VALVE ACTUATOR ASSEMBLY

(75) Inventor: Zongxuan Sun, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/942,542

(22) Filed: Sep. 16, 2004

Related U.S. Application Data

(60) Provisional application No. 60/587,328, filed on Jul. 13, 2004.

(51) Int. Cl.[7] ..... F01L 9/02

(52) U.S. Cl. ..... 123/90.12; 123/90.15; 123/90.11; 123/90.13; 251/30.01; 251/129.03; 251/129.15

(58) Field of Search ..... 123/90.12, 90.15; 251/30.01

(56) References Cited

U.S. PATENT DOCUMENTS

| | | | | |
|---|---|---|---|---|
| 5,456,222 | A | 10/1995 | Schechter | 123/90.12 |
| 5,638,781 | A | 6/1997 | Sturman | 123/90.12 |
| 6,109,284 | A | 8/2000 | Johnson et al. | 137/1 |
| 6,173,685 | B1 * | 1/2001 | Sturman | 123/90.12 |
| 6,263,842 | B1 | 7/2001 | DeOjeda et al. | 123/90.12 |
| 6,739,293 | B2 * | 5/2004 | Turner et al. | 123/90.12 |
| 6,837,196 | B2 * | 1/2005 | Sun | 123/90.12 |

FOREIGN PATENT DOCUMENTS

| | | | | |
|---|---|---|---|---|
| EP | 1464794 | A2 * | 10/2004 | F01L 9/02 |

* cited by examiner

*Primary Examiner*—Thomas Denion
*Assistant Examiner*—Kyle M. Riddle
(74) *Attorney, Agent, or Firm*—Kathryn A. Marra

(57) ABSTRACT

A valve actuator assembly for an engine includes a movable engine valve, a movable spool valve and four on/off valves. An intermediate channel interconnects the spool valve and first and second on/off valves. A driving channel connects the spool valve and a first fluid chamber for driving the engine valve. First and second feedback channels communicate between the second and third fluid chambers and fourth and fifth fluid chambers of the spool valve. Third and fourth on/off valves enable and disable the feedback channels to improve valve controllability.

13 Claims, 3 Drawing Sheets

SELF-REGULATING ELECTROHYDRAULIC VALVE ACTUATOR ASSEMBLY

CROSS-REFERENCE TO RELATED APPLICATIONS

This application claims priority from U.S. Provisional Patent Application No. 60/587,328 filed Jul. 13, 2004.

TECHNICAL FIELD

This invention relates to engine valvetrains and, more particularly, to an electrohydraulic valve actuator assembly for an internal combustion engine.

BACKGROUND OF THE INVENTION

Valve actuator assemblies for camless valvetrains of internal combustion engines have been proposed in the art. Such valve actuator assemblies often result high energy consumption, low repeatability from cycle to cycle and cylinder to cylinder and high seating velocity-induced noise. Some valve actuator assemblies do not provide full capability of variable lift. They may also be of relatively high cost and have large packaging size.

It is desirable to provide a valve actuator assembly that improves controllability. It is also desirable to provide a valve actuator assembly having increased flexibility and full capacity for variable lift. Further, it is desirable to provide a valve actuator assembly that reduces energy consumption and provides satisfactory seating velocity. Therefore, there is a need in the art to provide a valve actuator assembly for an engine that meets these desires.

SUMMARY OF THE INVENTION

The present invention provides a new camless engine valve actuator assembly that has dual automatic regulation for controllability.

The valve actuator assembly includes a movable engine valve, a movable spool valve and four on/off valves. The valve actuator assembly also includes a driving channel interconnecting the spool valve and the engine valve, an intermediate channel interconnecting the spool valve and a pair of parallel on/off valves, and a pair of feedback channels interconnecting the engine valve, the spool valve and a second pair of on/off valves.

The first and second on/off valves control fluid flow to and from the spool valve. The spool valve in turn controls fluid flow to the driving channel to position the engine valve. Third and fourth on/off valves regulate feedback fluid pressure to provide dual automatic regulation for valve controllability and flow control.

An advantage of the present invention is that the valve actuator assembly has dual hydraulic feedback for precise motion by self-regulating flow control. Also, the valve actuator assembly has controllability that is open loop stable with dual automatic regulation. Another advantage is that the valve actuator assembly provides improved valvetrain stability without sacrificing dynamic performance. The valve actuator assembly also enables improved engine performance and fuel economy and lower engine emissions by improved valve control. The valve actuator assembly minimizes energy consumption by self-regulation flow control, a simple spool valve and efficient valve control to minimize throttling of the fluid flow. The spool valve and the four on/off valves create dual feedback to provide both precise valve lift control and soft valve landing. Another advantage of the valve actuator of the present invention is that it is of relatively small size and easy to package in an engine.

These and other features and advantages of the invention will be more fully understood from the following description of certain specific embodiments of the invention taken together with the accompanying drawings.

DESCRIPTION OF THE PREFERRED EMBODIMENT

Figure 1:
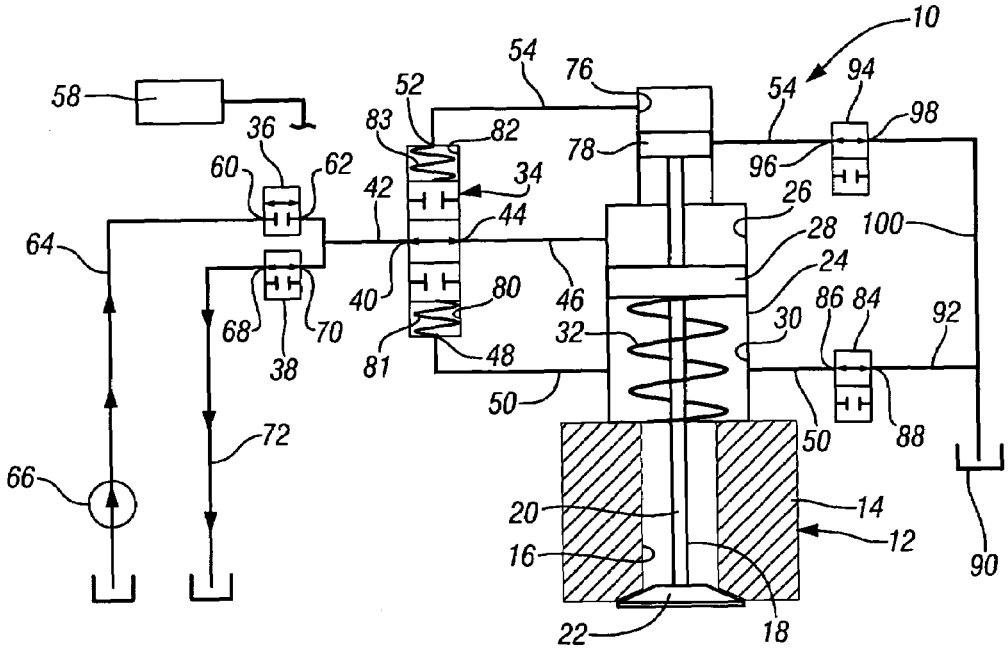
FIG. 1 is a diagrammatic view of a valve actuator assembly, according to the present invention, illustrated in operational relationship with an engine of a vehicle.
Figure 2:
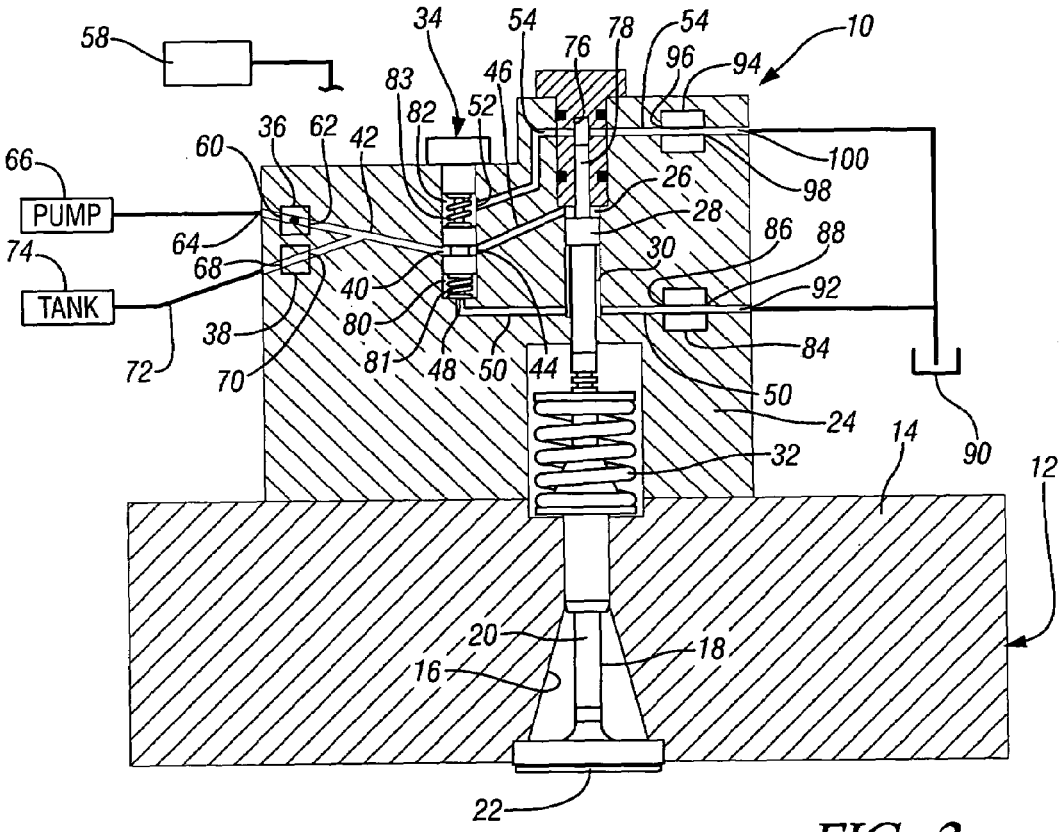
FIG. 2 is a cross-sectional view of the valve actuator assembly of FIG. 1 in an engine valve closed position.

Referring first to FIGS. 1 and 2 of the drawings in detail, numeral 10 generally indicates an electrohydraulic valve actuator assembly mounted on a cylinder head 12 includes at least one opening 16 in communication with an internal combustion chamber, not shown, of the engine. The cylinder head 12 also includes a movable engine valve 18 for each opening 16. The engine valve 18 has a valve stem 20 and a valve head 22 at one end of the valve stem. The engine valve 18 is movable between open and closed positions within its respective opening 16. It should be understood that the engine valve 18 may be either an intake or an exhaust valve.

The valve actuator assembly 10 further includes a valve housing 24 mounted on the cylinder head 12. The valve housing 24 has a main or first fluid chamber 26 therein. A first piston 28 is connected to or in contact with the valve stem 20 of the engine valve 18. The piston 28 is disposed in the first fluid chamber 26 of the valve housing 24 and forms a second fluid chamber 30 in the housing. An engine valve spring 32 is disposed about the valve stem 20 between the cylinder head 12 and the piston 28 to bias the engine valve 18 toward the closed position so that the valve head 22 closes the opening 16, as shown in FIG. 2.

The valve actuator assembly 10 also includes a spool valve 34, fluidly connected to the first fluid chamber 26 of the valve housing 24, and first and second on/off valves 36, 38. The spool valve 34 is of a three position two-way type. The spool valve 34 has a first port 40 fluidly connected by an intermediate channel 42 to the first and second on/off valves 36, 38 and a second port 44 fluidly connected by a driving channel 46 to the first fluid chamber 26. The spool valve 34 also has a third port 48 fluidly connected by a first feedback channel 50 to the second fluid chamber 30 and a fourth port 52 fluidly connected by a second feedback channel 54 to a third fluid chamber to be described. It should be appreciated that the spool valve 34 controls fluid flow to and from the first fluid chamber 26.

The first on/off valve 36 is of a two position two-way type and is electrically connected to a source of electrical power such as a controller 58. The first on/off valve 36 has first and second ports 60, 62. The first port 60 is fluidly connected via a fluid supply line 64 to a pressurized fluid source such as a pump 66. The second port 62 is fluidly connected to port 40 of the spool valve 34 and the second parallel on/off valve 38 via the intermediate channel 42. It should be understood that the on/off valve 36 is normally closed when de-energized and opened when energized by the controller 58.

The second on/off valve 38 is also of a two position two-way type and is electrically connected to a source of electrical power such as the controller 58. The second on/off valve has first and second ports 68, 70. The first port 68 is fluidly connected via return line 72 to a fluid tank 74. The second port 70 is fluidly connected to port 40 of the spool valve 34 and a first on/off valve 36 via the intermediate channel 42. It should be understood that the on/off valve 38 is normally closed when de-energized and opened when energized by the controller 58.

The fluid pump 66 may be fluidly connected to draw fluid from the fluid tank 74 or from a separate fluid tank, not shown.

The valve actuator assembly 10 further includes a third fluid chamber 76 axially spaced from the first fluid chamber and defined by the housing 24. A second piston 78, connected to the first piston 28, is disposed in the third fluid chamber.

The valve actuator assembly 10 also includes a fourth fluid chamber 80 defined by the housing 24 at one end of the spool valve 34. A first spool valve spring 81 is disposed within the fourth fluid chamber 80 to bias the spool valve toward an oppositely spaced fifth fluid chamber 82, to be described. The fourth chamber 80 communicates with the second chamber 30 via the first feedback channel 50.

The valve actuator assembly 10 further includes the fifth fluid chamber 82 defined by the housing 24 and the spool valve 34 and oppositely spaced from the fourth chamber 80. A second spool valve spring 83 is disposed within the fifth chamber 82 to bias the spool valve toward the fourth chamber 80. The fifth chamber 82 communicates with the third chamber 76 via the second feedback channel 54.

It should be appreciated that the spool valve springs 81 and 83 bias the spool valve 34 toward a center or open position when fluid pressure in the fourth and fifth chambers 80 and 82 is equal. It should also be understood that a change in fluid pressure in either the fourth or the fifth chambers 80 and 82 should be able to overcome the opposing spool valve spring 81 and 83 and cause the spool valve 34 to move into a closed position.

The valve actuator assembly further includes a third on/off valve 84 fluidly connected to the second fluid chamber 30 of the valve housing 24. The third on/off valve is of a two position two-way type and is electrically connected to a source of electrical power such as the controller 58. The third on/off valve 84 has first and second ports 86, 88. The first port 86 is fluidly connected by the first feedback channel 50 to the second fluid chamber 30. The second port 88 is fluidly connected to a fluid tank 90 by a low pressure line 92. It should be appreciated that the fluid thank 90 is able to maintain certain level of back pressure. It should be understood that the third on/off valve 84 is normally opened when de-energized and closed when energized by the controller 58.

The valve actuator assembly 10 further includes a fourth on/off valve 94 fluidly connected to the third fluid chamber 76 of the valve housing 24. The fourth on/off valve 94 is also of a two position two-way type and is electronically connected to a source of electrical power such as the controller 58. The second on/off valve 94 has first and second ports 96, 98. The first port 96 is fluidly connected by the second feedback channel 54 to the third fluid chamber 76. The second port 98 is fluidly connected to the fluid tank 90 by a low pressure line 100. If desired, the pressure line 100 may be fluidly connected to the fluid tank 90 or a separate fluid tank, not shown. It should be understood that the fourth on/off valve 94 is normally opened when de-energized and closed when energized by the controller 58.

In operation, as illustrated by FIG. 2, the engine valve 18 is shown in the closed position. In this position, the first on/off valve 36 is de-energized (closed) by the controller 58 to prevent the flow of pressurized fluid to the spool valve 34. The second on/off valve 38 is energized (opened) by the controller 58 to expose the first chamber 26 to the fluid tank 74. The third and fourth on/off valves 84 and 94 are both de-energized (opened) to expose the second and third fluid chambers 30 and 76 to the fluid tank 90 to allow the springs 81, 83 to center the spool valve 34 in the open position. The engine valve spring 32 keeps the engine valve 18 closed with the valve head 22 closing the opening 16.

Figure 3:
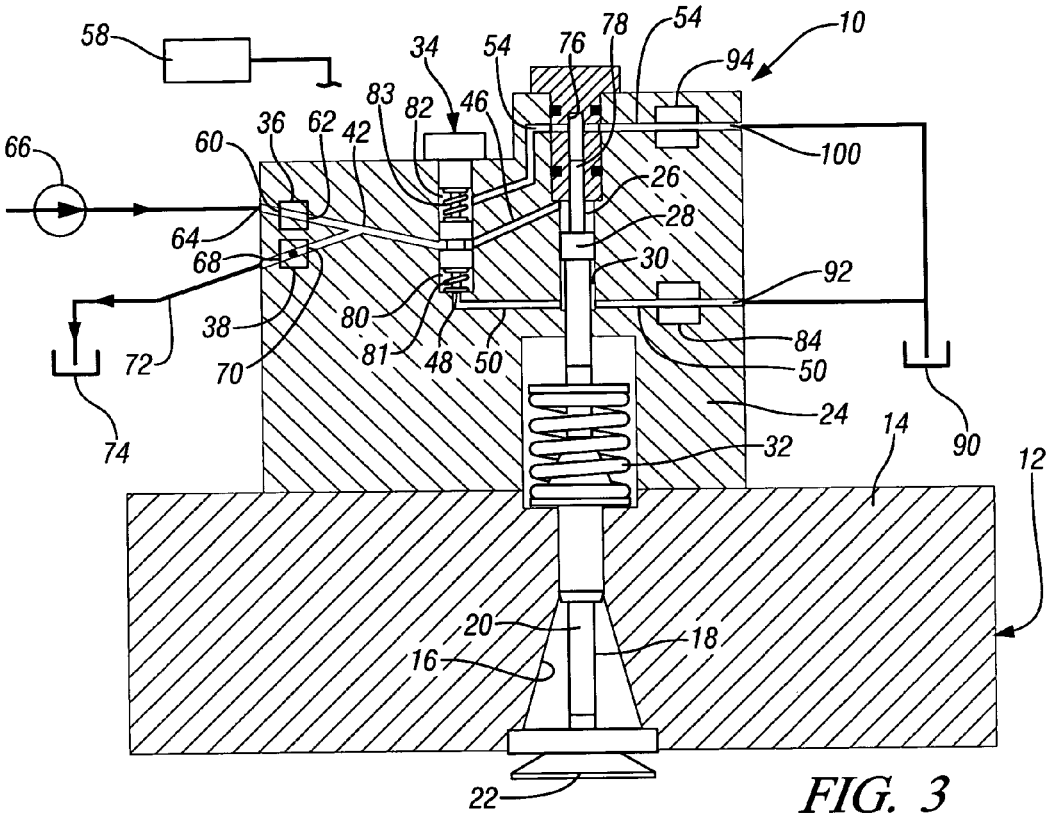
FIG. 3 is a similar view of the valve actuator assembly of FIG. 1 in an engine valve opening position.

To open the engine valve 18, as illustrated in FIG. 3, the controller 58 energizes (opens) the first on/off valve 36 and de-energizes (closes) the second on/off valve 38 to allow high pressure fluid to flow from the pump 66 through the spool valve 34 and into the first chamber 26. The high pressure overcomes the force of the engine valve spring 32 and moves the engine valve 18 to an opening position. The third and fourth on/off valves 84 and 94 are both de-energized (opened) to allow the fluid in the second and third chambers 30 and 76 to flow to and from the tank 90.

Figure 4:
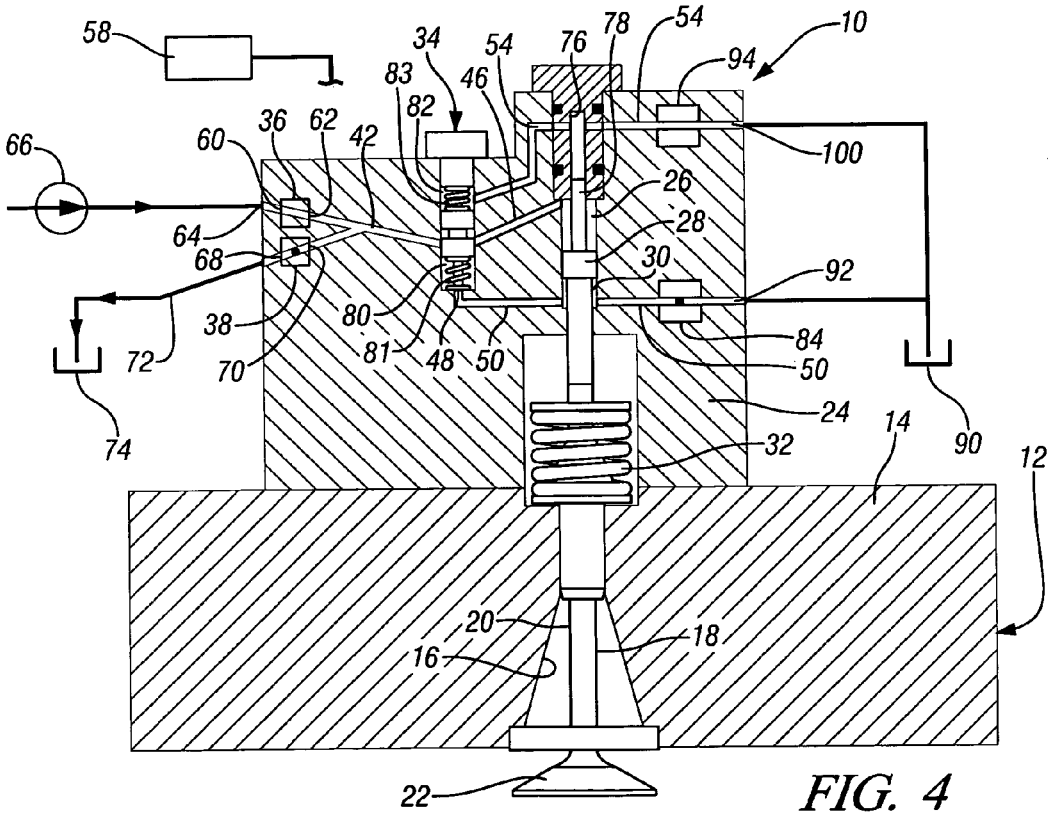
FIG. 4 is a similar view of the valve actuator assembly of FIG. 1 in an engine valve opened position.

To stop the engine valve 18 at a predetermined lift position, the controller 58 energizes (closes) the third on/off valve 84 to cut of the fluid connection between the second fluid chamber 30 and the tank 90. As the engine valve 18 continues to open, the first piston 28 pushes the fluid in the second fluid chamber 30 via the feedback channel 50 into the fourth fluid chamber 80, which drives the spool valve 34 upward against spool valve spring 83. This motion continues until the spool valve 34 cuts off the fluid connection between the driving channel 46 and the intermediate channel 42 and reaches its mechanical stop. When the spool valve 34 reaches this equilibrium point, the engine valve 18 stops as illustrated in FIG. 4. It should be understood, the lift height of the engine valve 18 is determined by the triggering timing of the third on/off valve 84.

Figure 5:
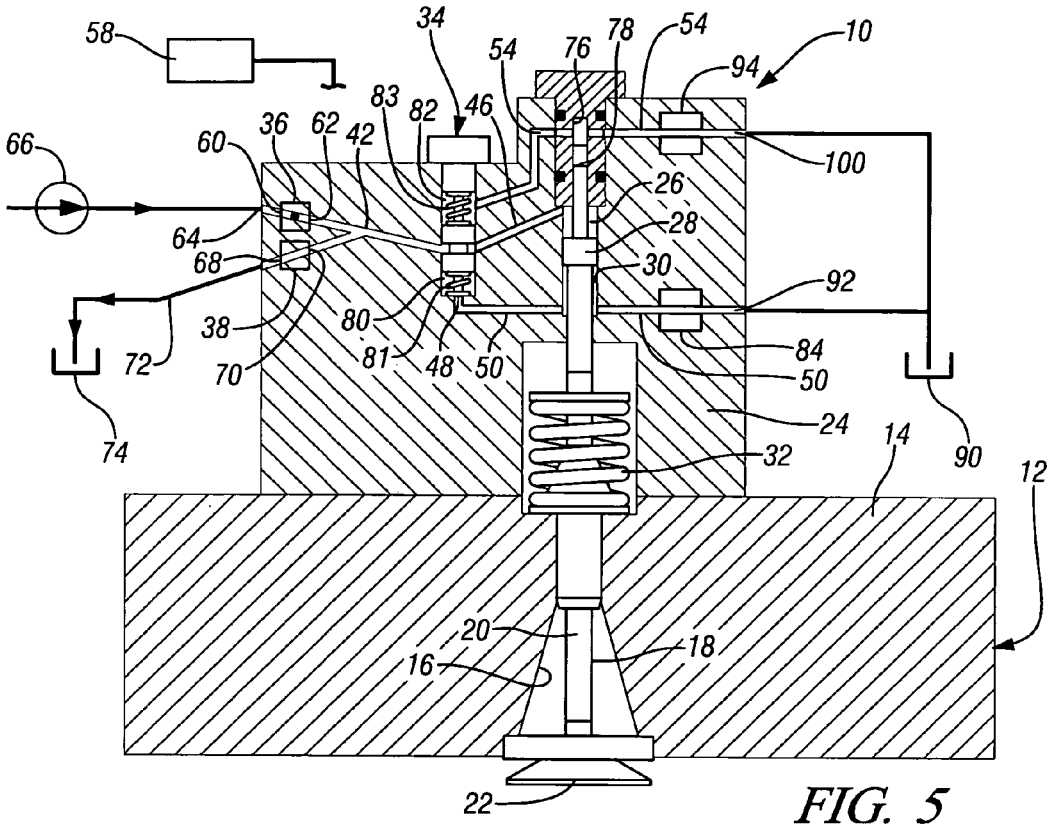
FIG. 5 is a similar view of the valve actuator assembly of FIG. 1 in an engine valve closing position.

To close the engine valve 18, the controller 58 de-energizes (closes) the first valve 36, de-energizes (opens) the third on/off valve 84 and energizes (opens) the second on/off valve 38. The spool valve springs 81 and 83 return the spool valve 34 to the central position to expose the first chamber 26 to the intermediate channel 42 and the low pressure line 72 and the fluid tank 74. This allows the high pressure fluid in the first chamber 26 to exhaust into the fluid tank 74. The engine valve spring 32 then drives the engine valve 18 upward, as illustrated in FIG. 5. As the engine valve 18 returns to the closed position, the third and fourth on/off valves 84 and 94 remain de-energized (opened) so that both the second fluid chamber and the third fluid chamber 30 and 76 are connected with the fluid tank 90, causing the low pressure fluid to fill or drain these chambers as the engine valve returns to the closed position.

To stop the engine valve 18 at a predetermined position while the engine valve 18 is returning to the seated or closed position, the controller 58 energizes (closes) the fourth on/off valve 94 to cut off the fluid connection between the third chamber 76 and the fluid tank 90, causing the upward moving engine valve 18 to displace fluid from the third chamber 76 to the fifth chamber 82 of the spool valve 34.

Figure 6:
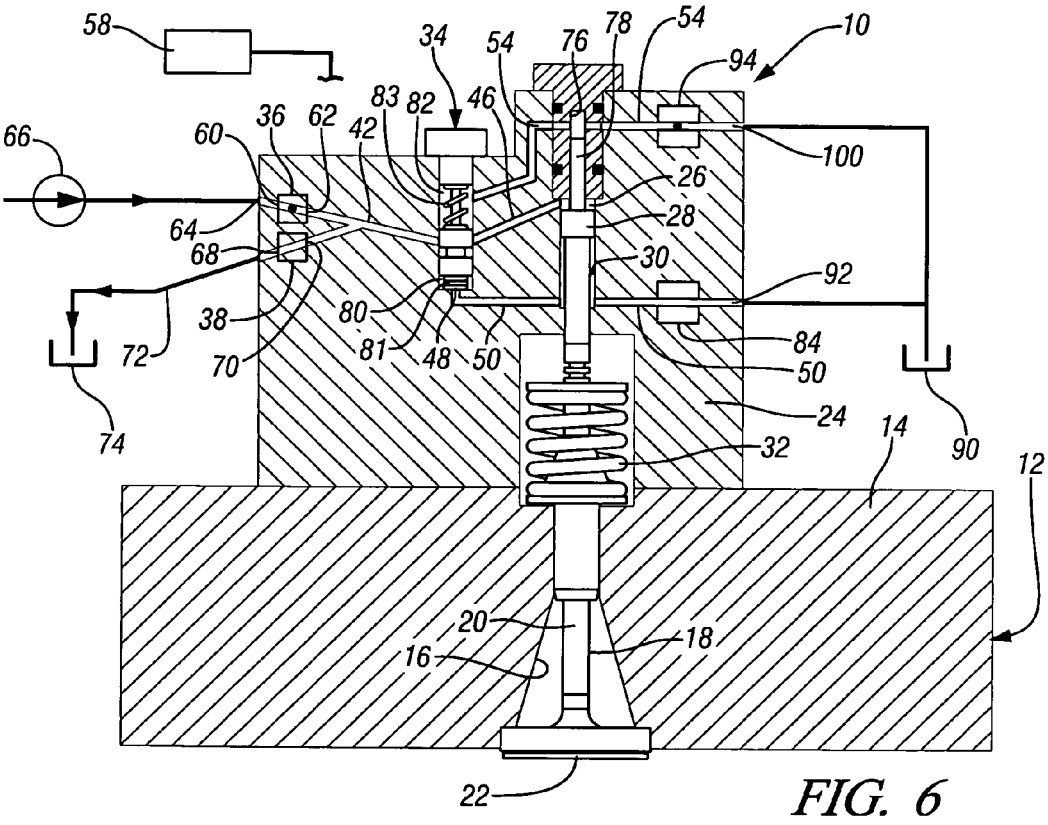
FIG. 6 is a similar view of the valve actuator assembly of FIG. 1 in an engine valve closed position.

This motion continues until the spool valve 34 cuts off the connection between the driving channel 46 and the intermediate channel 42 and reaches it mechanical stop. When the spool valve 34 reaches this equilibrium point, the engine valve 18 stops as illustrated in FIG. 6. This allows for better control of the impact velocity at seating ("soft landing") of the engine valve 18.

The valve actuator assembly 10 is made open-loop stable by utilizing the hydraulic feedback channels 50 and 54 and the on/off valves 84 and 94 are used to enable or disable the feedback channels, respectively. Open-loop stability implies that the system's response to a given input signal is not unbounded. The better controllability achieved by open loop stability enables the valve actuator assembly 10 to provide better performance. The valve actuator assembly 10 of the present invention precisely controls the motion of the spool valve 34 though the feedback channels 50 and 54 so that it avoids unnecessary throttling of the low pressure flow and high pressure flow, thereby providing energy consumption benefits.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A valve actuator assembly for an internal combustion engine, the assembly comprising:

a movable engine valve;

a movable spool valve;

a spring biasing the engine valve to a closed position;

a driving channel interconnecting the spool valve and the engine valve;

an intermediate channel interconnecting the spool valve and first and second on/off valves;

a first feedback channel interconnecting the engine valve, the spool valve and a third on/off valve;

a second feedback channel interconnecting the engine valve, the spool valve and a fourth on/off valve;

a control operable to energize and de-energize the first and second on/off valves to selectively provide fluid flow to and from the spool valve and the driving channel to position the engine valve between an open position and the closed position; and a control operable to energize and de-energize the third and fourth on/off valves to selectively enable and disable the feedback channels to control the motion of the spool valve.

2. A valve actuator assembly as in claim 1 including a valve housing.

3. A valve actuator assembly as in claim 2 wherein the valve housing has a first fluid chamber fluidly communicating with the driving channel and a second fluid chamber fluidly communicating with the first feedback channel.

4. A valve actuator assembly as in claim 3 including a first piston operatively cooperating with the engine valve and being disposed in the valve housing and having the first fluid chamber on one side and the second fluid chamber on the other side.

5. A valve actuator assembly as in claim 3 including a first on/off channel interconnecting the second fluid chamber and the third on/off valve.

6. A valve actuator assembly as in claim 3 wherein the valve housing has a third fluid chamber fluidly communicating with the second feedback channel.

7. A valve actuator assembly as in claim 6 including a second piston operatively cooperating with the engine valve and being disposed in the said valve housing and having the third fluid chamber on one side thereof.

8. A valve actuator assembly as in claim 7 including a second on/off valve channel interconnecting the third fluid chamber and the fourth on/off valve.

9. A valve actuator assembly as in claim 1 including a fourth fluid chamber at one end of the spool valve and fluidly communicating with the first feedback channel and a fifth fluid chamber at an opposite end of the spool valve fluidly communicating with the second feedback channel.

10. A valve actuator assembly as in claim 9 including a first spool valve spring biasing the spool toward the fifth fluid chamber.

11. A valve actuator assembly as in claim 9 including a second spool valve spring biasing the spool valve toward the fourth fluid chamber.

12. A valve actuator assembly as in claim 1 including a controller electronically connected to the on/off valves to energize and de-energize the on/off valves.

13. A method of operating a valve actuator assembly for an engine, including the steps of:

providing a movable engine valve;

providing an engine valve spring disposed about the engine valve and biasing the engine valve toward a closed position;

providing a movable spool valve;

providing a first and second on/off valves operable to control fluid flow to and from the spool valve;

actuating the first on/off valve to an open position and the second on/off valve to a closed position and supplying high pressure fluid through the first on/off valve to the spool valve and a driving channel interconnecting the spool valve and the engine valve with high pressure fluid to move the engine valve to an open position;

supplying a first feedback channel interconnecting the spool valve and the engine valve with fluid flow;

supplying a second feedback channel interconnecting the spool valve and the engine valve with fluid flow; and enabling and disenabling the first feedback channel via a third on/off valve and enabling and disenabling the second feedback channel via a fourth on/off valve and controlling motion of the spool valve.

* * * * *